United States Patent [19]

Giannetti et al.

[11] Patent Number: 5,007,627

[45] **Date of Patent: * Apr. 16, 1991**

[54] SCUFF SHEET SEPARATING DEVICE

[75] Inventors: John Giannetti, Penfield; Jerry F. Sleve, Henrietta; Robert H. Shea, Victor, all of N.Y.

[73] Assignee: Eastman Kodak Company, Rochester, N.Y.

[ * ] Notice: The portion of the term of this patent subsequent to Jul. 4, 2006 has been disclaimed.

[21] Appl. No.: 366,399

[22] Filed: Jun. 15, 1989

Related U.S. Application Data

[63] Continuation-in-part of Ser. No. 137,775, Dec. 24, 1987, Pat. No. 4,844,435.

[51] Int. Cl.[5] ..... B65H 3/04

[52] U.S. Cl. ..... 271/35; 271/121

[58] Field of Search ..... 271/34, 35, 121, 122, 271/124, 125

[56] References Cited

U.S. PATENT DOCUMENTS

| | | | |
|---|---|---|---|
| 2,665,906 | 1/1954 | Johnson | 271/125 |
| 3,372,925 | 3/1968 | de Vries et al. . | |
| 3,984,095 | 10/1976 | Zimmer . | |
| 3,990,694 | 11/1976 | Mason et al. . | |
| 4,050,690 | 9/1977 | Michalson | 271/34 X |
| 4,054,092 | 10/1977 | Loftus et al. . | |
| 4,480,827 | 11/1984 | Shultz et al. . | |
| 4,496,145 | 1/1985 | Fukui . | |
| 4,500,084 | 2/1985 | McInerny . | |
| 4,546,963 | 10/1985 | Dinnissen . | |
| 4,573,675 | 3/1986 | Suyatsky | 271/125 X |
| 4,638,987 | 1/1987 | Sakurai . | |
| 4,844,435 | 7/1989 | Giannetti | 271/10 |

FOREIGN PATENT DOCUMENTS

| | | |
|---|---|---|
| 2432461 | 2/1980 | France . |
| 1071521 | 6/1967 | United Kingdom . |
| 1387817 | 3/1975 | United Kingdom . |

*Primary Examiner*—Richard A. Schacher

*Attorney, Agent, or Firm*—Leonard W. Treash, Jr.

[57] ABSTRACT

A scuff separating device capable of feeding difficult to separate sheets from the outside of a stack includes a feed belt or roller for contacting the outside sheet and feeding it off the stack. A retard roller is supported by a support arm pivoted about a pivot downstream, and rests on the feed belt or roller and prevents double feeds. A brake on the retard roller prevents rotation when more than one sheet is in the nip but permits rotation when one or no sheets are in the nip.

9 Claims, 7 Drawing Sheets

SCUFF SHEET SEPARATING DEVICE

RELATED APPLICATIONS

This application is a continuation-in-part of U.S. patent application Ser. No. 137,775 filed Dec. 24, 1987, now U.S. Pat. No. 4,844,435, issued July 4, 1989.

This application is related to co-assigned:

U.S. patent application Ser. No. 137,776, entitled DUPLEX DOCUMENT HANDLER, field Dec. 24, 1987 in the names of John Giannetti, Robert L. Couture, Jerry F. Sleve and Robert H Shea; now U.S. Pat. No. 4,884,097, issued Nov. 28, 1989.

U.S. patent application Ser. No. 137,777, entitled DOCUMENT SHEET SUPPORT MECHANISM, filed Dec. 24, 1987 in the names of John Giannetti, Jerry F. Sleve and Timothy H. Kelley, now U.S. Pat. No. 4,853,746, issued Aug. 1, 1989.

U.S. patent application Ser. No. 137,683, entitled IMPROVED SHEET SEPARATING DEVICE, filed Dec. 24, 1987 in the names of John Giannetti and Jerry F. Sleve, now U.S. Pat. No. 4,822,021.

TECHNICAL FIELD

This invention relates to a device for separating a sheet from a stack of sheets. More specifically, it relates to a scuff separating device suitable for use in a document handling apparatus or other demanding applications.

BACKGROUND ART

Although the sheet separating art is quite old, modern copiers, printers and scanners have required its perfection. The most critical sheet separating task in a copier or scanner is the document handler. In order to maintain the page sequential order of a stack of original document sheets, the sheets are commonly fed off the bottom of the stack. Because of the weight of the stack, bottom separation is more difficult than top separation. To further complicate the task, the copier is asked to handle used originals which vary in size, weight, age and condition. Not surprisingly, nearly all document handlers presently on the market come with instructions not to feed originals of unusual weight or of poor condition.

The predominant technology in high speed document handling involves separation of the bottom sheet from the stack with either a vacuum roller or a vacuum belt. These devices permit high speed feeding of a variety of documents without damage. However they generate noise which must be muffled, are expensive and require substantial power.

Other sheet separating tasks in copiers and printers have also become demanding. These apparatus are being asked to print onto a large variety of both paper and transparency stock. Copy sheet input mechanisms may feed a wide variety of sheets from as many as three or more sources and are asked to feed sheets hand supplied to the top of a stack of different weight sheets. Finishers often supply separator sheets and covers of greatly varying weight and texture. Duplex tray mechanisms are asked to feed a variety of sheets that may be poorly stacked and have toner images on one side that are easily smudged. Even though most of these applications involve feeding from the top of the stack, a much easier task than bottom feeding, vacuum feed is often used because of the variety of sheet types to be fed.

Scuff separating devices are much less expensive than vacuum devices, use less power and create less noise. They are commonly used in copiers and printers to feed blank copy sheets from the top of a stack. However, they have been considered too unreliable for separating sheets from a stack of used document sheets or from a stack of sheets having varying characteristics. They are especially difficult to apply to bottom feeding configurations. Prevention of double feeding and non-feeding in known scuff feeders is difficult with both such top and bottom separation applications. More important, because of reliance upon friction and a certain amount of slippage, they have been considered likely to damage more frail sheets.

U.S. Pat. Nos. 2,665,906 and 4,480,827 disclose top scuff separating devices in which the problems of slippage have been reduced by use of a braked retard roller opposite a larger drive roller. Although these structures have been in the literature for many years, to the best of applicants' knowledge, the principles have not been widely applied to the demands of the most difficult top or bottom separating problems. A possible reason why these structures have not seen substantial use is that each of them appears to require adjustment of the brake for extreme of paper weight and stack height. In the applications mentioned above, a variety of papers and stack heights is a normal condition.

DISCLOSURE OF THE INVENTION

It is the object of the invention to provide a scuff separating device which feeds a variety of sheets reliably from a stack, including both the top and bottom of a stack.

It is another object of the invention to provide such a scuff separating device that can reliably feed sheets from a stack of varying height and varying weight.

These and other objects are accomplished by a sheet separating device having a feed means located in contact with a sheet of a received stack. Retard means is positioned at the leading edge of the stack and against the feed means to prevent double feeding along a path between the feed and retard means. The retard means includes at least one rotatable retard member and a brake for said retard member. The coefficients of friction of the feed means and of the retard member are greater than the coefficients of friction of received sheets. The braking force is chosen such that rotation of the retard member occurs when one or no sheets are in the path, but does not occur when two or more sheets are in the path, thereby restraining movement of a second sheet in the path. The retard member is mounted on a support arm having a pivot which is downstream of the retard member. Preferably, the pivot is spaced from the path by enough distance that an increased stack force against the retard member, created in part by the pull on the stack by the feed means, rotates the retard member about the pivot to increase the separating force of the retard member. It thus applies an automatic adjustment for the height and weight of the stack.

According to a preferred embodiment the support arm and the sheet being fed make an angle of between 15 and 40 degrees and the frictional force between the retard member and a sheet being fed tends to rotate the arm to increase the retard force on the sheet.

This structure has the usual advantages of scuff separating, such as, low cost, quietness and simplicity. Surprisingly, however, unlike prior scuff sheet separating devices, it can be used to separate, off the top or bottom of a stack, sheets of greater varying characteristics with the reliability required of quality document handling or other demanding applications. Especially remarkable is its ability to feed varying used original documents off the bottom of a stack.

BEST MODE OF CARRYING OUT THE INVENTION

Figure 1:
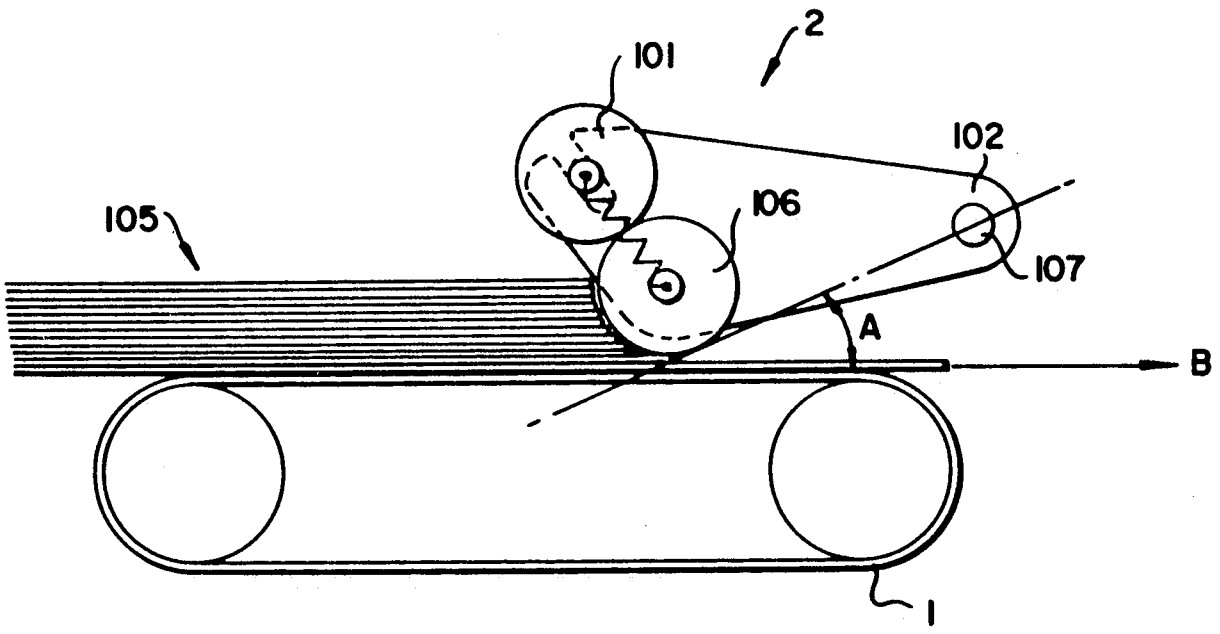
FIG. 1 is a schematic side view of a scuff separating device illustrating the invention.

According to FIG. 1, the invention is illustrated by application to bottom scuff separation, the most difficult of applications. A feed means, for example, feed belt 1 engages the bottom sheet in a stack 105 of sheets to be fed, one by one, along a feed path B. To prevent double feeds a retard means 2 is provided. The retard means 2 includes a retard member, for example, a retard roller 106 and a brake, for example, braking roller 101. Retard roller 106 is mounted on a support arm 102 and is gravity (or spring or both) urged toward engagement with feed belt 1 to provide a nip defining path B and through which the sheets are fed by belt 1.

To prevent double feeds, braking roller 101 is adjusted to restrict rotation of retard roller 106 to an amount such that it does not rotate when there are two sheets in the nip. More specifically, the coefficients of friction of both belt 1 and roller 106 are quite high, for example, in excess of 1.5. The coefficients of friction for all sheets likely to be fed is comparatively low, for example, less than 1.0. Thus, with enough braking force by braking roller 101, the bottom (first) sheet will slide on the second sheet and the second sheet will remain fixed in the nip as the bottom sheet is separated. As long as there are two or more sheets in the stack, the retard roller behaves as though it were an ordinary nonrotatable scuff retard means. However, when a single sheet is left to be fed, the force urging it along path B by belt 1 is greatly increased without another sheet between it and roller 1. In ordinary scuff separation devices, it moves through the nip by sliding on the retard member, an action which may damage a frail sheet. According to FIG. 1, however, the brake allows the retard roller to rotate under this greater force. No sheet slides on either of the rollers in any mode of operation. If there is at any time no sheet in the nip, the retard roller also rolls with the belt, saving wear on both, common in prior scuff feeders.

The range of this structure is greatly increased by supporting retard roller 106 on support arm 102 which is pivoted about a pivot 107. Pivot 107 is downstream of roller 106 and is separated from path B on the retard roller side of path B forming a working angle A which is enough that forces on the retard roller parallel to path B tend to rotate arm 102 counterclockwise as shown in FIG. 1 to apply greater retarding force in the nip. Preferably angle A is between 15 and 40 degrees.

The two principle forces parallel to path B on the retard roller 106 are that exerted by the friction in the nip and that exerted by the stack itself as it is pulled in the direction of the feed of the sheets by friction between the sheets in the stack. Thus, the greater the mass of the stack, the greater will be the retard force exerted on the second sheet. Similarly, the greater the tendency of the second sheet to move with the first sheet, the greater will be the retard force on the second sheet. This automatic increase in the retard force on the second sheet increases the range of types of sheet that can be separated. When the device is separating thick sheets of heavy paper that has a high coefficient of friction (for paper), the extra force exerted by the first sheet on the second sheet tends to rotate roller 106 into the second sheet resisting its movement with the top sheet and permitting separation. More fragile sheets that separate more easily are not subjected to the same force and are saved from possible damage.

The action of the stack is more subtle. With a large stack to be fed, the edge of the stack, made up of the leading edges of the sheets also exerts a similar force on the retard roller 106 to increase the retard or separation force. This extra force is important in the bottom feeding situation because the stack weight increases the frictional force between the bottom and the second sheet. Thus, the larger the stack the greater the rotational force around pivot 107 when that force is most needed. Thus, it automatically adjusts for a larger stack.

Support arm 102 also permits the retard roller to roll up on a second sheet as the top sheet moves through the nip and follows path B. When thick sheets are to be fed as required in some applications, this movement widening the nip can be substantial and is permitted by support arm 102.

Thus, as the first sheet leaves the nip, the weight of support arm 102 urges the retard roller toward the belt, pushing the formerly second sheet into engagement with feed roller 1. Feed roller 1 drives the second sheet through the nip. Because of the substantial frictional force between the retard roller and second sheet, the retard roller 106 rotates with the second sheet until it rides up on the third sheet whenever it arrives at the nip. The retard roller stops because the low frictional force between the two sheets controls and the second sheet is fed by sliding on the third sheet.

Figure 7:
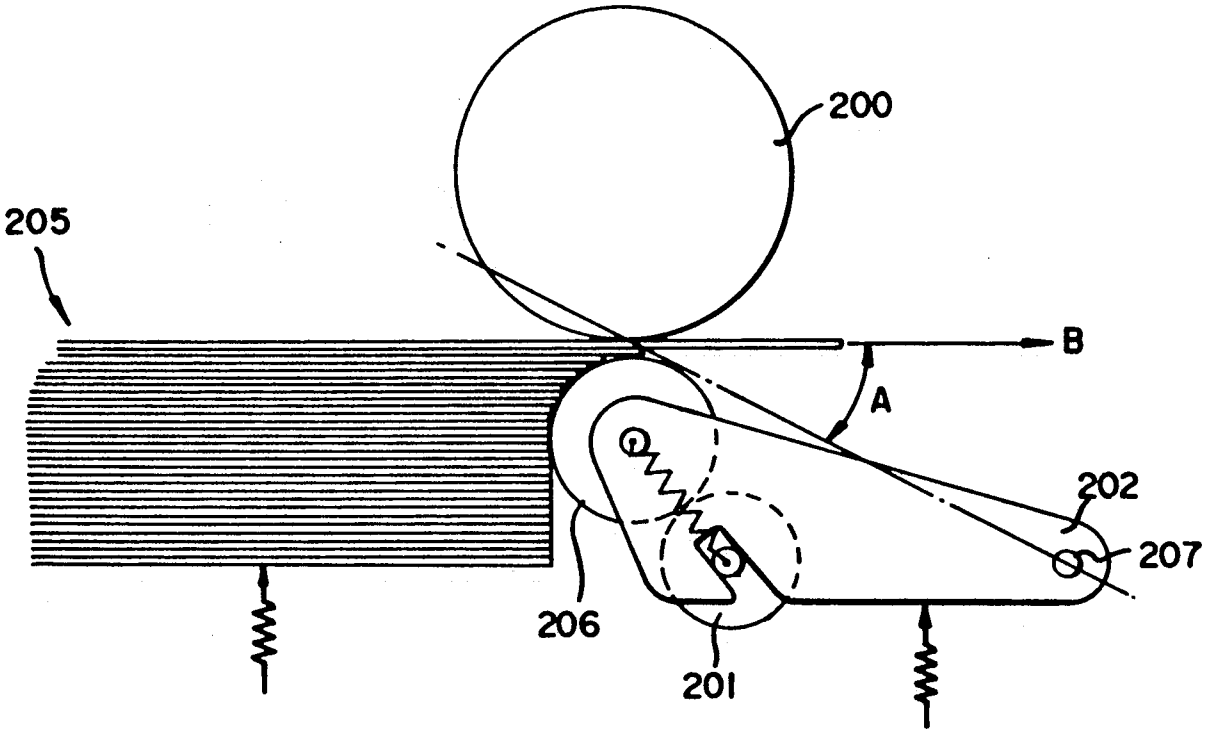
FIG. 7 is a schematic side view of a top separating embodiment of the invention.

Top feeding, without the weight of the stack as a problem, is not nearly as demanding as bottom feeding. However, when applied to top feeding the invention facilitates feeding a wider range of paper without adjustment, than prior art to scuff feeders. According to FIG. 7, a feed means, for example, feed roller 200, frictionally drives sheets off the top of a stack 205 and along a path B, tangent to roller 200. A retard roller 206 is spring urged toward contact with feed roller 200 forming a nip and partially defining path B. It is braked by braking roller 201. Retard roller 206 is supported downstream by support arm 202 which pivots about a pivot 207. The braking force applied by braking roller 201 resists rotation of retard roller 206 when two sheets are in the nip, firmly retarding the second sheet as the first slides with respect to it and is fed. When a single sheet is in the nip the increased driving force on that sheet by feed roller 200 overcomes the braking force and retard roller rolls with the sheet. Pivot 207 is separated from path B on the same side of path B as retard roller 206, forming a working angle A (also shown in FIG. 1). As a second sheet has an increasing tendency to be fed with the first sheet, the friction between roller 206 and the second sheet pivots arm 202 about pivot 207 into the second sheet to hold it in the nip.

The invention, while useful in top feeding situations, has its most remarkable application in bottom feeding where it is effective enough to permit bottom feeding of hard to feed originals in a document feeder. That will now be described in an application in a document feeder for an input scanner.

Referring to FIGS. 2–6 a scanner 3 includes a document handler 4 and an optical system housed in an optics housing 5. The optical system includes an illumination head 7 containing an exposure radiation source 8, an eliptical reflector 9 and a plane reflector 10. The illumination head 7 cooperates with a pair of movable mirrors 11, an objective 12 and an electrooptical image sensor having separately addressable pixels, for example, a CCD 13. Objective 12 and CCD 13 are stationary while the illumination head and a pair of movable mirrors are movable from the position shown in solid lines to the position shown in phantom in FIG. 2.

Figure 2:
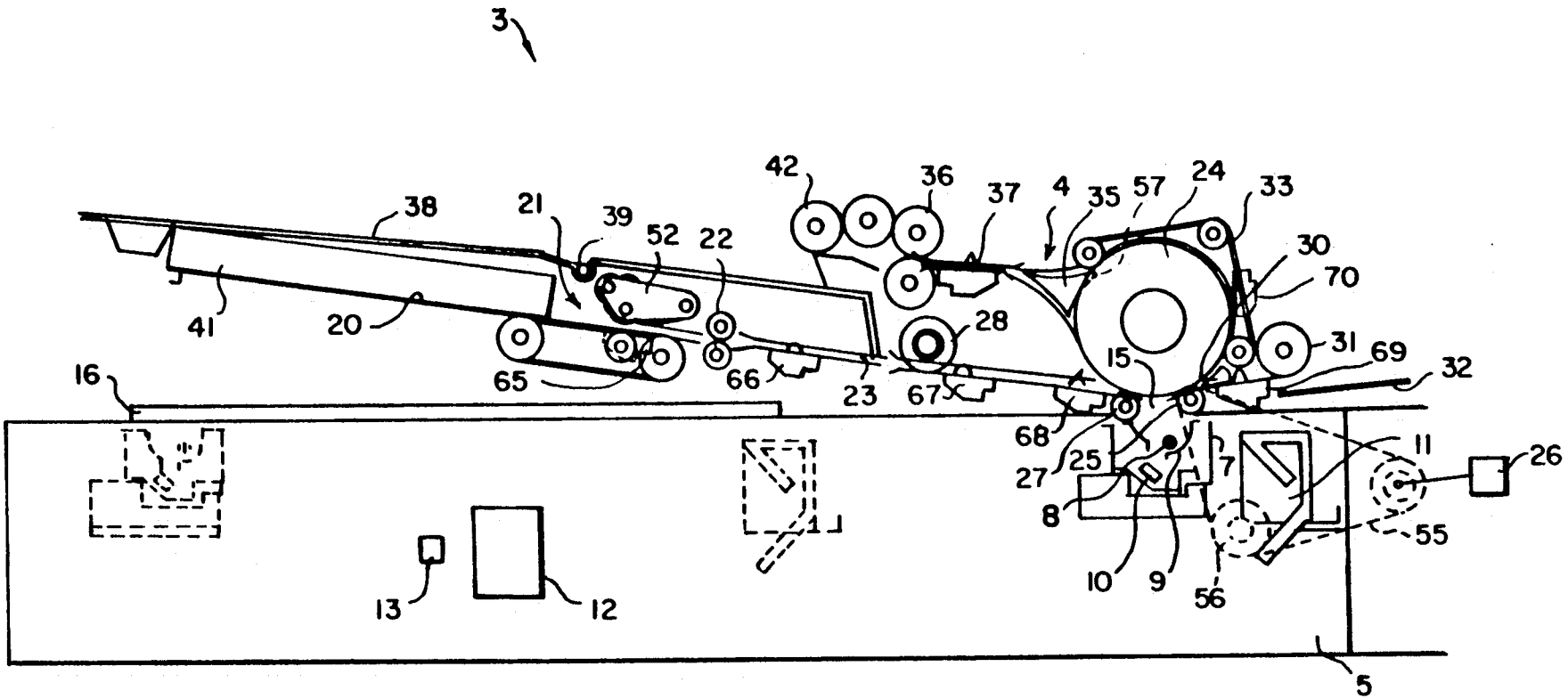
FIG. 2 is a side view of a feeder and scanner having a separating device according to a preferred embodiment of the invention, with many parts eliminated for clarity.

When the illumination head 7 is located in the position shown in solid lines in FIG. 2, it is positioned to project onto CCD 13 an image of a moving document presented by the document handler 4 to an exposure position 15. The illumination head 7 and mirrors 11 are movable by a pulley system, not shown, to scan an image of a document or other object placed on an exposure platen 16 onto CCD 13.

The document handler 4 includes a document supply or input tray 20 into which a multisheet (or single sheet) document is placed face down. Document sheets are fed one at a time from the bottom of the stack by a scuff separating device 21, constructed according to the invention and described more fully below. The input tray 20 is inclined approximately 7 degrees from the horizontal to gain the assistance of gravity in the separating process. Documents separated from the stack are fed by a pair of feed rollers 22 along an input path 23, defined by registration guides and having a registration roller 28 to a turnover drum 24. Turnover drum 24 is driven by drum drive rollers 25 and 27 which in turn are driven through a suitable clutch by a drive belt 55 driven by a motor 26. Drive belt 55 also drives a pulley 56, through a suitable clutch, which in turn drives the pulley system, mentioned above, for moving the optical components during platen mode copying. The document is fed across the exposure position 15 by the combined action of the drum drive rollers 25 and 27 driving both the document and the turnover drum 24. The turnover drum 24 is held tight against the drum drive rollers 25 and 27 to assure location of the document in the object plane of objective 12, also described more fully below.

If only one side of the document is to be scanned, a separator or diverter 30 is moved to a raised position which strips the document from turnover drum 24 and allows it to be fed by a simplex exit roller 31 into a simplex exit tray 32. Because the documents are placed face down in the document input tray 20 and are fed in that position across the exposure position 15 and into the simplex exit tray, and new documents are fed into the simplex exit tray on top of preceding documents, the stack of documents in the simplex exit tray ends up in the same order and orientation as in the document input tray 20.

If both sides of the document are to be scanned, diverter 30 is placed in its down position allowing the document to follow turnover drum 24. The document is held to turnover drum 24 positively by a set of belts 33 which are driven by turnover drum 24. The belts 33 also drive simplex exit roller 31 thereby maintaining constant velocity of the document in the simplex mode. In the duplex mode, the document is separated from the turnover drum 24 by a passive diverter 35 which directs the document into a turnaround path and between reversing rollers 36. The reversing rollers 36 are driven by separate means, for example, a reversible motor, not shown, and drive the document to the left as shown in FIG. 2 until the trailing edge of the document passes a sensor 37. The sensor 37 sends a signal to the drive means for reversing rollers 36, reversing the rotation of the rollers and feeding the document back to the right along the turnaround path. Passive diverter 35 now directs the document downward, between rollers 25 and 27 and across the exposure position 15 for exposure of the reverse side. As the reverse side is exposed, diverter 30 stays in the downward position allowing the document to once again continue with turnover drum 24 until directed by passive diverter 35 to feed back along the turnaround path to the reversing rollers 36. This time, reversing rollers 36, assisted by an additional duplex exit roller 42, driven by reversing rollers 36, continue to drive the document along this path until it is completely deposited into a duplex exit tray 38. A stack of duplex documents fed through this path will be stacked in the duplex exit tray 38 in the same order and orientation in which they were placed in the document input tray 20.

Figure 5:
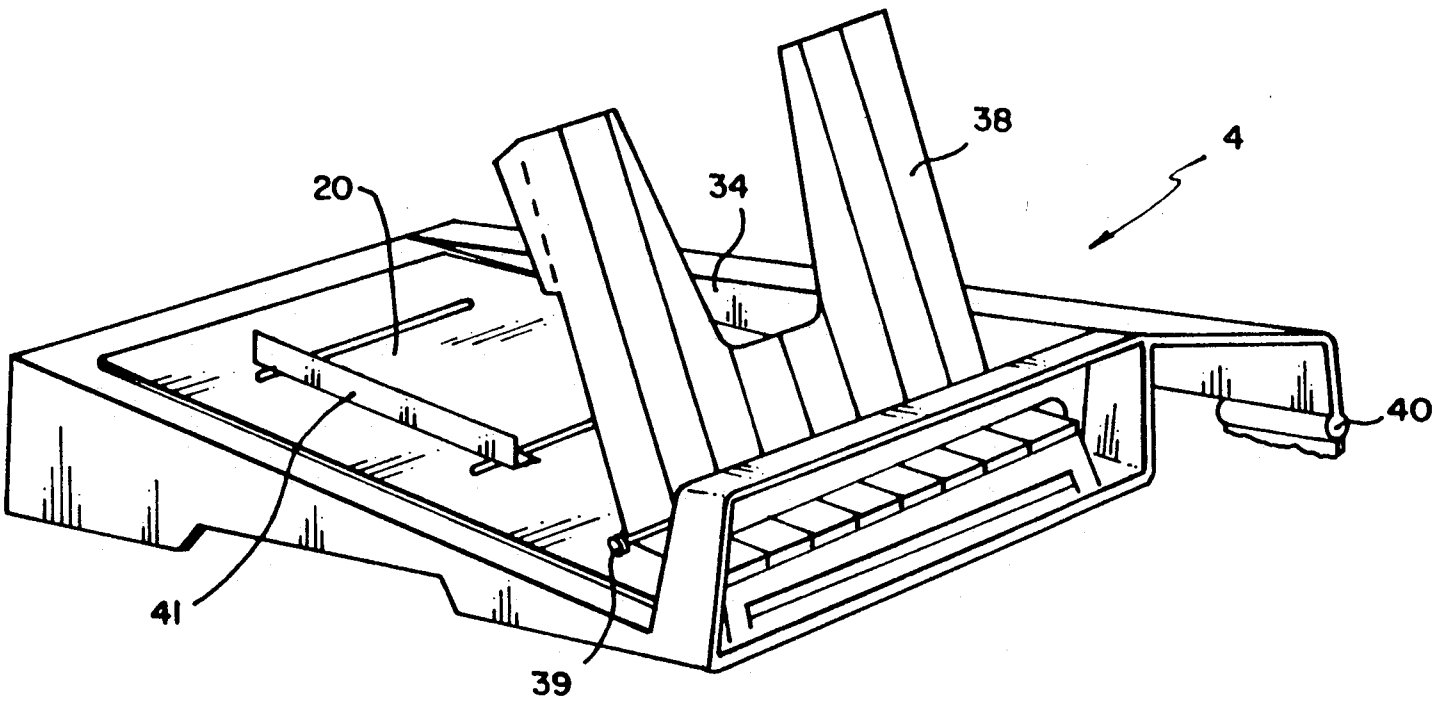
FIGS. 5 and 6 are exterior perspective views of the scanner illustrated in FIGS. 2 and 3.
Figure 6:
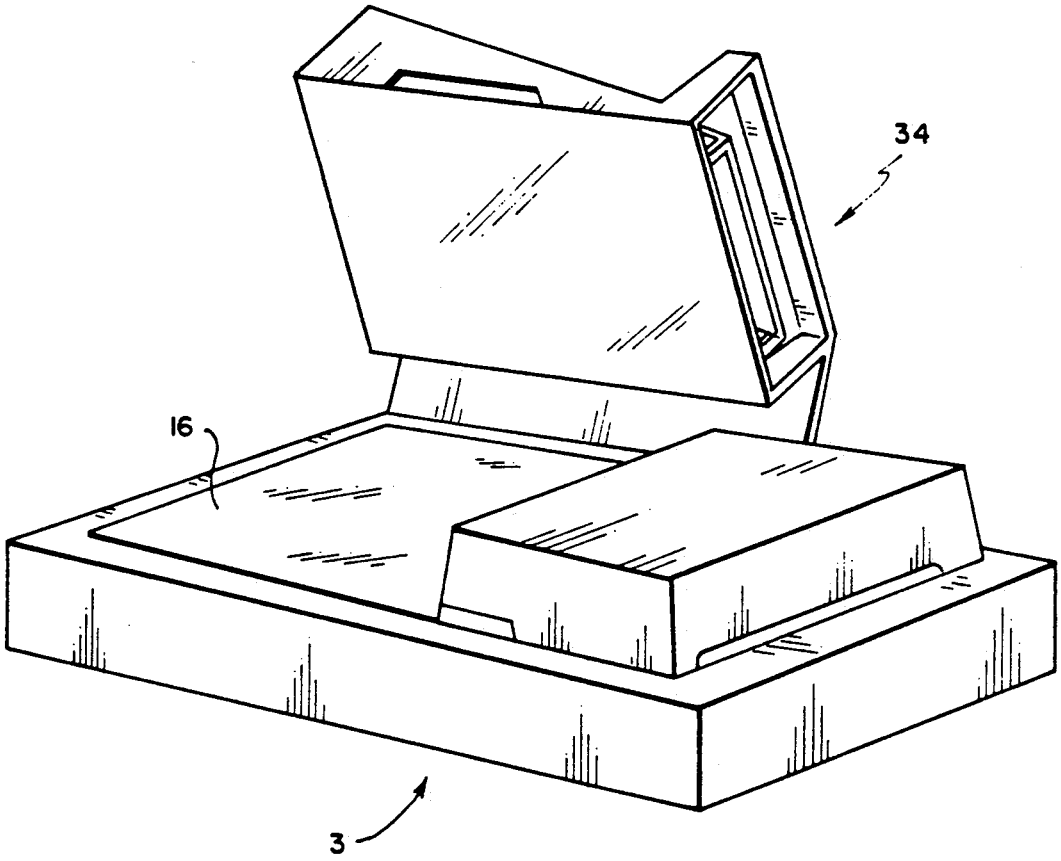

The duplex exit tray has a hinge 39 which allows it to be lifted to a position shown in FIG. 5, permitting access to the document input tray 20. The document input tray 20 is part of a structure which, in turn, is fastened by hinges 40 (FIG. 5) which permits raising of a portion 34 of the document handler left of reversing rollers 36 (FIG. 2) to provide access to the exposure platen 16 as shown in FIG. 6.

Referring to FIG. 5, the document input tray 20 includes an edge guide 41 which is adjustable to assure proper location of the multipage document against a fixed edge guide 34. The adjustable edge guide 41 may also be connectable by means not shown to the logic and control of the apparatus to input the size of the original document being scanned for purposes of automatic choice of magnification, copy sheet size and the like. Alternatively, a set of document sheet size sensors may be incorporated into the input tray for determining paper length and/or width, or one or both of these dimensions may be determined from the signal from CCD 13. These approaches may be combined, for example, by using sensors or edge guide 41 to determine cross-track size and the CCD signal to determine in-track size.

The scuff separating device 21 contributes substantially to the reliability of the document handler 4 of the scanner 3 while still being simple in construction and low in cost. Because it is a document separation device rather than as ordinary copy sheet separation device, it must work with whatever type of document sheet the user places in it. It may have to separate and feed document sheets that vary substantially in age, weight and condition.

Figure 3:
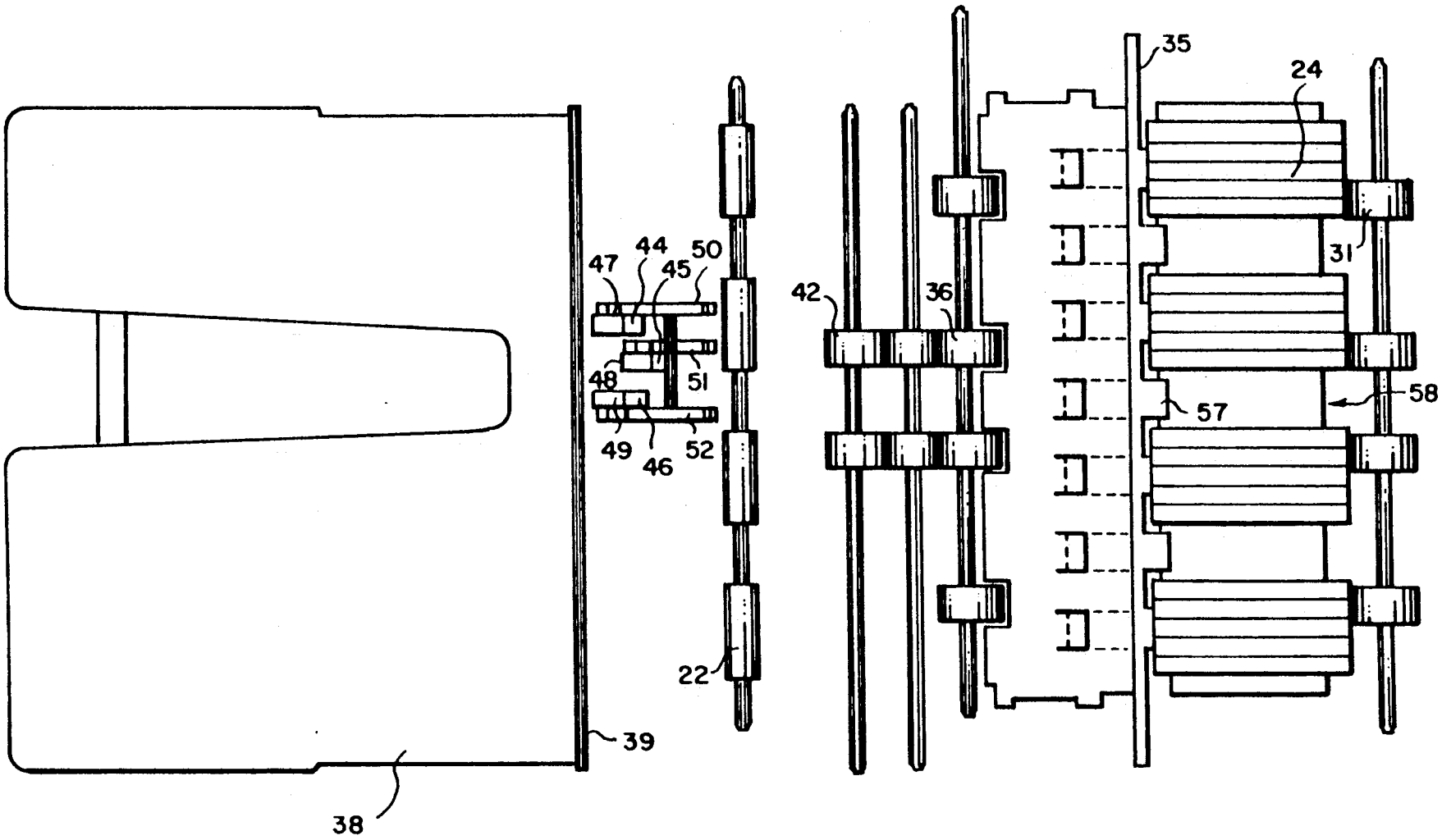
FIG. 3 is a top view of a portion of the apparatus shown in FIG. 2 with parts eliminated for clarity.
Figure 4:
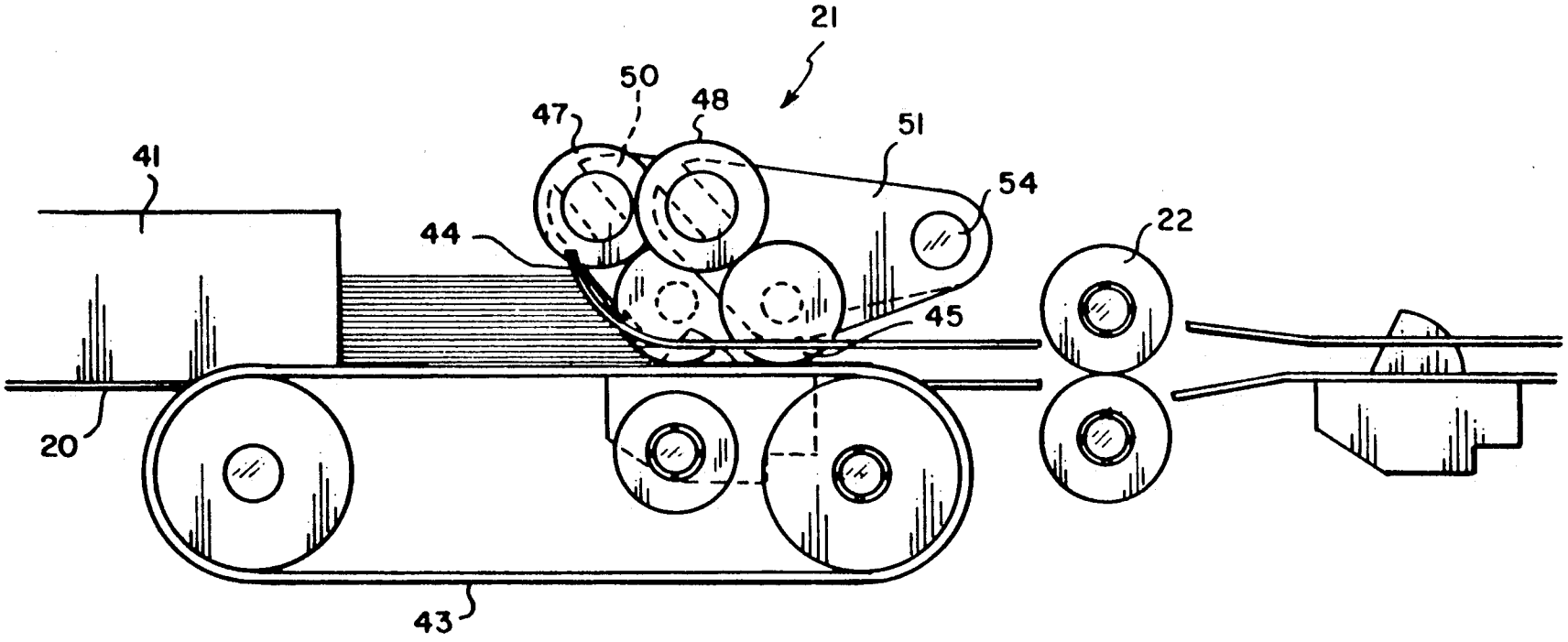
FIG. 4 is a side view of the separating device portion of the scanner shown in FIG. 2.

According to FIGS. 2, 3 and 4, the separating device 21 includes a scuff feed belt 43 positioned with its top surface slightly raised from the surface of document supply tray 20. Retard separating rollers 44, 45 and 46 are positioned opposite scuff feed belt 43 and are driven only by contact with belt 43 either directly or through document sheets to be fed. The retard rollers are engaged by brake rollers 47, 48 and 49, respectively, and are held by roller support arms 50, 51 and 52, respectively, which pivot about a rod 54. In the preferred embodiment of the device, the retard rollers are held against the belt 43 by their own weight and that of the braking rollers and the support arms. Additional force from springs could be used, but in most bottom feed applications unnecessarily complicates the device. The brake rollers are made of a softer material than the retard rollers. Support arm 52, retard roller 46 and brake roller 49 have been eliminated from FIG. 4 for clarity of illustration. Brake rollers 47, 48 and 49 are urged against retard rollers 44, 45 and 46 by conventional adjustable spring and screw mechanisms which establish a fixed center distance between the brake and retard rollers and which produces a compression of the softer brake roller resulting in the desired braking force on the retard roller.

In operation, a stack of document sheets is placed face down in supply tray 20 and feed belt 43 is driven in a clockwise direction. The coefficient of friction of the feed belt 43 is sufficiently high that it has a tendency to feed at least the bottom sheet of the stack toward drive rollers 22. The coefficient of friction of the retard roller 44, 45 and 46 is also high, i.e., it is higher than the coefficient of friction between any two sheets intended to be fed. The braking force applied by brake rollers 47, 48 and 49 is chosen such that retard rollers 44, 45 and 46 will be rotated by the belt when a single sheet of paper is between the retard rollers and the feed belt, permitting feeding of that single sheet of paper into feed rollers 22. If a second sheet of paper comes between any of the retard rollers 44, 45 or 46 and the bottom sheet of paper in the stack, the braking force on the retard roller in question is high enough to prevent rotation of the roller until the lower frictional force between the sheets is overcome. In this instance, the retard roller will not rotate and the second sheet will remain stationary underneath the retard roller while the bottom sheet is separated and fed by belt 43. If no sheets are between the belt and the retard rollers, the high coefficients of friction of the belt and retard rollers will cause the feed belt 43 to overcome the braking force applied by brake rollers 47, 48 and 49 and directly rotate the retard rollers. Thus as each sheet is fed, a very small incremental rotation of the retard rollers will occur presenting a clean surface to assist in retarding. This incremental rotation is proportional to the lead edge distance between sheets as they are fanned around the retard roller at the start of a job.

This system has a number of advantages. Unlike prior retard systems, at not time is there intended to be any slippage between the scuff belt 43, the retard rollers 44, 45 and 46 and the documents. Only slippage between document sheets is permitted. Thus, this system will successfully feed documents that prior systems would tear or smear. In addition, because of the high coefficients of friction on the drive and retard elements, contact pressure between the belt, rollers and sheets can be greatly reduced over conventional scuff systems, also reducing document damage and smudging. The frictional force applied by the retard rollers and also by the belt only has to be greater than the frictional force between the sheets while the braking force need only be small enough to permit turning of the roller when a single sheet or no sheet is present and large enough to prevent turning when two sheets are present. Because friction between sheets is generally quite light, this tolerance is extremely wide and allows a great latitude in materials used, rarely gets out of adjustment and permits feeding of a wide variety of types of documents. For example, the coefficient of friction for most papers is less than 1.0. In theory, the coefficient of friction on the retard rollers can be anything in excess of that. In fact, the weight of the stack adds to the frictional force between the document sheets, so that, coefficients of friction in excess of 2.0 are preferred for both the retard rollers and the scuff belt 43. No special relationship is required between the coefficients of friction of the belt and the retard rollers, as would be required in conventional scuff systems relying on slippage between a retard means and one side of a single sheet being fed.

Reliability of the system is improved by positioning retard roller 45 at a different in-track position from retard rollers 44 and 46. The distance between pivot rod 54 and the center of retard roller 45 is different from the distance to rollers 44 and 46. In addition to changing the in-track position of roller 45, this construction provides slightly different working angles between the roller arms and the direction of travel of a sheet being fed by scuff separating device 21. If two sheets are in fact fed between the belt 43 and rollers 44 and 46 those two sheets will be picked up separately by retard roller 45 and the top sheet retained while the bottom sheet continues on its path. This can happen if three sheets of paper somehow get between retard rollers 44 and 46 and the belt 43, with only the top sheet being retained by the retard rollers at that position. For example, if a stack is placed in the input tray 20 with the leading edge of one sheet well behind its adjacent sheets, both bottom sheets may be fed together, with the middle sheet eventually stopped by the downstream retard roller 45. Because of the slightly greater angle of attack (working angle) provided by roller arm 51 compared to roller arms 50 and 52 retard roller 45 will exert slightly more force to retard the second sheet, assuming the force applied by the braking rollers is the same. This factor also has a tendency to reduce the number of double feeds.

The angle (comparable to angle A in FIGS. 1 and 2) between the roller support arm pivot 54 and the nips is quite small, for example, in the range of 15 to 40 degrees. This permits the separation and feeding of different thicknesses of paper. The location of the pivot rod 54 downstream from the retard rollers, has a tendency to increase the force retarding the second sheet when the roller is not rolling, i.e., when there are two sheets in the nip, but desirably relaxes the force somewhat when the roller is rotating, i.e., when there is only one or no sheets in the nip. As explained with respect to FIG. 1, any increased force on the retard rollers parallel to the path of the sheet increases the retard force against the second sheet. This increased retard force is especially useful in bottom feeding applications because the weight of a large stack increases the frictional force between the sheets. The frictional forces between the bottom two sheets resist their separation. However, the weight of the stack is also pulled by the feed belt against the retard rollers. Because the retard rollers are pivoted as shown, the stack increases the retard force, at least partially compensating for the increased frictional force between the sheets caused by the large stack.

It is recognized in the art that belt feed mechanisms contact a greater area of a sheet than do roller feed devices and are therefore preferred for many applications. A larger proportion of the stack weight is supported by the belt compared to the input tray which increases the force moving the bottom sheet and decreases the drag from the tray. A roller would need a much higher coefficient of friction to have the same effect. Since paper is never completely flat, the greater area reduces the probability that contact will be lost. Belts also have some tendency to be more efficient because all motion of the top of the belt is in the direction of feeding while a roller drives fully in that direction only where tangential velocity is in the feed direction.

Despite these advantages and perhaps because of lower cost, rollers are more commonly used than belts for scuff separating devices. U.S. Pat. Nos. 2,665,906 and 4,480,827, cited above, suggest top separating devices with braked retard rollers and feed rollers. These devices do not have the retard roller mounted on a support arm with a downstream pivot and therefore do not provide an automatic adjustment for increased stack and/or sheet separation resistance. Further, the scuff belt described herein has features not taken advantage of in the prior art roller or belt devices. As the belt 43 advances it tries to both rotate the retard rollers and to pivot the arms 50, 51 and 52 about rod 54. The arms deflect the belt downwards until the desired brake force is overcome allowing the rollers to turn or until friction between the sheets is overcome allowing the bottom sheet to slide on the sheet next to it. This deflection of the belt generates a high localized normal force between the sheet to be separated and the belt, which forces are not applied to the rest of the stack.

Another aspect of the use of the scuff belt unique to this structure is that it permits the use of the multiple retard system embodied in roller 45, and explained above, which greatly enhances the prevention of double feeding when trying to separate sheets from dishevelled stacks.

The ability of each retard roller to both pivot about rod 54 and to rotate is a significant aspect of the preferred embodiment of this separating device. It permits the separation device to separate sheets of varying thicknesses, an important feature of a document feeder and a limiting characteristic of prior scuff feeders. In operation, as a sheet is fed it will slightly rotate the retard roller until the roller rolls and pivots up on the leading edge of the next (second) sheet, at which point the first sheet is advanced by the belt with the second sheet restrained by the roller. The roller stops its roll and upward pivot immediately after it lifts off the bottom sheet regardless of the thickness of the sheet. If the belt is depressed by the force of the retard roller the retard roller moves with the belt to maintain the best distance for the respective thicknesses of the sheets preventing a greater opening that might result in a double feed.

The document handling portion 4 contains a number of sensing devices 65, 66, 67, 68, 69 and 70 in addition to previously mentioned sensing device 37. These devices are generally placed at strategic points to detect either the front edge, the rear edge of a document or the lack of either at the right time, to actuate the various components downstream from those sensing devices or signal that a jam has occurred.

The entire scanner 3 is driven by three motors. Motor 26, described above, drives drive belt 55 which drives drive roller 25 through a suitable clutch and hence duplex drum 24 and associated rollers and belts. Roller 27 is connected to roller 25 to also be positively driven by motor 26. As mentioned above, motor 26 and its drive belt 55 also drive pulley 56 through a suitable clutch and pulley system, not shown, for moving illumination head 7 and the pair of movable mirrors 11, as is well known in the art. Turnaround rollers 36 and rollers abutting them are driven by a separate reversible drive motor, not shown, and scuff feed belt 43 is driven by its own drive motor, also not shown.

Drive rollers 22 are driven by the same motor driving the scuff feed belt 43. However, through a suitable clutch, not shown, scuff feed belt 43 is stopped after ad document has reached rollers 22. It is started again when sensor 65 senses the trailing edge of the document. Sensor 65 is positioned to provide a suitable interframe, for example, 2.5 cm between the documents.

This invention has been described in detail with particular reference to preferred embodiments thereof, but it will be understood that variations and modifications can be effected within the spirit and scope of the invention.

We claim:

1. A sheet separating device for separating a sheet from a stack, said separating device including feed means located in contact with the outside sheet of a received stack, retard means positioned in contact with said feed means at the leading edge of the stack to prevent double feeding along a feed path between said retard means and said feed means, said retard means including at least one rotatable retard member and a brake for said retard member, the coefficients of friction of the feed means and of the retard member being greater than that of the sheets to be fed, the brake exerting a braking force upon rotation of the retard member sufficient to prevent rotation when two or more sheets are in said path but permitting rotation when only one or no sheets are present in said path, and a rigid pivot arm supporting said retard means, said pivot arm being pivotable about a pivot located downstream of said retard means, on the same side of the feed path as the retard means and separated from such path by a distance sufficient to cause rotation of the retard means about said pivot into a fed sheet in response to a force against the retard means parallel to the path.

2. A sheet separating device having feed means positioned to frictionally engage the outside sheet in a stock and drivable to feed said outside sheet off the stack, retard means positioned against said feed means to prevent double feeding between said retard means and said feed means, said retard means including at least one retard roller mounted on a support arm which support arm is pivotable about an axis downstream of the retard means and spaced from the sheet path on the retard means side of said path, the coefficients of friction of the feed means and of the retard means being greater than that of the sheets to be fed, and said retard means including a braking roller urged against the retard roller to exert a braking force upon rotation of said retard roller sufficient to prevent rotation thereof when two or more sheets are in said path but permitting rotation when only one or no sheets are present in said path.

3. A sheet separating device according to claim 2 wherein one of said retard roller and said braking roller is composed of a relatively soft material.

4. A sheet separating device according to claim 2 wherein said drive means is a drive roller which contacts the top sheet of a stack and said retard roller is positioned below said drive means and is spring urged into engagement with said drive roller.

5. A sheet separating device for separating a sheet form a stack, said separating device including means for receiving a stack of sheets to be fed one at a time, feed means located to contact the bottom sheet of a received stack, and to feed such sheet off the stack, retard means positioned to form a nip with said feed means at the leading edge of the stack to prevent double feeding along a path through said nip, the retard means engaging the leading edge of the stack as it tends to move with the sheet to be fed, said retard means including at least one rotatable retard member and a brake for said retard member, the brake exerting a braking force upon rotation of the retard member sufficient to prevent rotation when two or more sheets are in said path but permitting rotation when only one or no sheets are present in said path, and a rigid pivot arm supporting said retard means, said pivot arm being pivotable about a pivot located downstream of said retard means, on the same side of the plane of a sheet being fed as the retard means, and separated from said plane by a distance sufficient to cause rotation of the retard means into the sheet as a result of the force exerted on the retard member by the edge of the stack to increase the retarding force of the the retard means in response to an increased stack height.

6. A sheet separating device according to claim 5 wherein said retard member is a retard roller and wherein a plane through the nip and the pivot makes an angle with the plane of a sheet being fed through the nip which is between 15 and 40 degrees.

7. A sheet separating device for separating a sheet from a stack, said separating device including feed means for contacting and feeding the outside sheet of a received stack along a feed path, retard means positioned in contact with said feed means to prevent double feeding along said path between said retard means and said feed means, said retard means including at least one rotatable retard roller which forms a nip with said feed means and a brake for said retard roller, the coefficients of friction of the feed means and of the retard roller being greater than that of the sheets to be fed, the brake exerting a braking force upon rotation of the retard roller sufficient to prevent rotation when two or more sheets are in said path but permitting rotation when only one or no sheets are present in said path, and a rigid pivot arm supporting said retard roller, said pivot arm being pivotable about a pivot located downstream of said retard roller, and located such that a plane through said nip and the pivot makes an angle with the plane of a sheet being fed through the nip which is between 15 and 40 degrees, and the frictional force of a sheet contacting said retard member tends to pivot the retard member about the pivot into the sheet when said retard member is in its nonrotational mode.

8. A sheet separating device having feed means positioned to frictionally engage the outside sheet in a stack and drivable to feed said outside sheet off the stack, retard means positioned against said feed means to prevent double feeding between said retard means and said feed means, said retard means including a plurality of retard rollers each mounted on a separate support arm which support arms are pivotable about a common axis downstream of the retard means and spaced from the sheet path on the retard means side of said path, the coefficients of friction of the feed means and of the retard means being greater than that of the sheets to be fed, and said retard means including a braking roller urged against each of said retard rollers to exert a braking force upon rotation of said retard roller sufficient to prevent rotation thereof when two or more sheets are in said path but permitting rotation when only one or no sheets are present in said path.

9. A sheet separating device according to claim 8 wherein at least one of said retard rollers is mounted on a support arm that is shorter than the support arm of at least one of the other retard rollers to intersect said path downstream of said other retard rollers.

* * * * *